US007155948B2

(12) United States Patent
Hellgren

(10) Patent No.: US 7,155,948 B2
(45) Date of Patent: Jan. 2, 2007

(54) FORMING TOOL

(75) Inventor: Keijo Hellgren, Västerås (SE)

(73) Assignee: Avure Technologies AB, Vasteras (SE)

( * ) Notice: Subject to any disclaimer, the term of this patent is extended or adjusted under 35 U.S.C. 154(b) by 0 days.

(21) Appl. No.: 10/514,402

(22) PCT Filed: Apr. 2, 2003

(86) PCT No.: PCT/SE03/00525

§ 371 (c)(1),
(2), (4) Date: Oct. 28, 2005

(87) PCT Pub. No.: WO03/097268

PCT Pub. Date: Nov. 27, 2003

(65) Prior Publication Data

US 2006/0086166 A1 Apr. 27, 2006

Related U.S. Application Data

(60) Provisional application No. 60/384,175, filed on May 29, 2002.

(30) Foreign Application Priority Data

May 15, 2002 (SE) ..... 0201489

(51) Int. Cl.
*B21D 28/18* (2006.01)

(52) U.S. Cl. ..... 72/55; 72/63

(58) Field of Classification Search ..... 72/55, 72/56, 57, 63

See application file for complete search history.

(56) References Cited

U.S. PATENT DOCUMENTS 3,222,902 A * 12/1965 Brejcha et al. ..... 72/56
3,611,765 A * 10/1971 Harvey ..... 72/55
3,678,577 A * 7/1972 Weglin et al. ..... 72/55
5,649,438 A 7/1997 Hall, Jr. et al. ..... 72/60
6,178,796 B1 * 1/2001 Hellgren ..... 72/63
6,513,359 B1 * 2/2003 Binder et al. ..... 72/57
6,591,649 B1 * 7/2003 Gafri et al. ..... 72/56
6,708,542 B1 * 3/2004 Gafri et al. ..... 72/56

FOREIGN PATENT DOCUMENTS

DE 199 51 850 C1 1/2001
EP 0 288 705 A2 11/1988
SU 940930 7/1982

* cited by examiner

*Primary Examiner*—David B. Jones
(74) *Attorney, Agent, or Firm*—Harness, Dickey & Pierce, P.L.C.

(57) ABSTRACT

The invention relates to a forming tool for forming sheet blanks in a diaphragm press of the kind comprising an openable, closed pressure chamber, which is divided in a gas and liquid tight manner by means of a flexible diaphragm. The forming tool is arranged on one side of the diaphragm and a sheet blank to be formed is arranged between the forming tool and the diaphragm. The opposite side of the diaphragm is pressurized by a fluid being supplied at high pressure to cause the flexible diaphragm to deform and, thus, the sheet blank to be pressed against the forming tool. The forming tool comprises an elongate cutting and flanging tool along at least part of its periphery and/or around an intended opening in the sheet blank.

6 Claims, 4 Drawing Sheets

FORMING TOOL

The present invention relates to a forming tool for forming sheet blanks in a diaphragm press of the kind comprising an openable, closed pressure chamber, which is divided in a gas and liquid tight manner by means of a flexible diaphragm, the forming tool being adapted to be arranged on one side of the diaphragm and a sheet blank to be formed being adapted to be arranged between the forming tool and the diaphragm, while the opposite side of the diaphragm is adapted to be pressurised by a fluid being supplied at high pressure to cause the flexible diaphragm to deform and, thus, the sheet blank to be pressed against the forming tool, the forming tool further comprising a cutting edge, so that the sheet blank is both formed into the desired shape and cut to the desired size in a single forming step.

BACKGROUND ART

In connection with forming sheet blanks, such as sheets of steel or aluminium for use in vehicles, it is known to use so-called diaphragm presses of the kind described above. In such a press, a forming tool is provided in a closed press chamber and the sheet blank to be formed is arranged between the forming tool and an elastic diaphragm of rubber or a polymer, which divides the press chamber in two separate chamber portions in a gas and liquid tight manner. By supplying a liquid at high pressure at the opposite side of the diaphragm, the diaphragm will be deformed and press the sheet blank against the forming tool whereby the blank obtains the desired shape. Forming using diaphragm presses of this kind is particularly advantageous in conjunction with relatively small production runs, since the cost of manufacturing the forming tools is relatively low.

However, in forming operations using a diaphragm press, as in every other kind of forming operation, it is desirable that, to the utmost possible extent, the blank be formed into a finished product in one single forming step, thereby avoiding, as far as possible, any subsequent machining that would increase the costs. Thus, it is desirable that, in the forming operation, the blank be cut to the correct size and shape and that, if desired, flanged edges be formed, said flanged edges being used, for example, for attaching the finished blank and for connecting it to other structural elements of the end product, such as a vehicle.

EP 0 288 705 discloses a forming tool for diaphragm presses by means of which it is possible to cut the sheet-metal blank to the desired size and to form a flanged edge along the periphery of the cut sheet-metal blank. This is achieved by the forming tool having cutting bars with a sharp cutting edge along the circumference of the forming tool and recesses for forming the flanged edges after cutting. During the forming process, the sheet-metal blank will, at a certain degree of deformation, be pressed against the cutting edges, which will cause the sheet to rupture and be cut off to the predetermined size, flanged edges being then formed at the cut-off edge portions by said portions being pressed into the recesses provided therefor in the forming tool. One drawback of this forming tool is, however, that the sheet-metal blank has to be deformed over a very long distance before it reaches the cutting edge and is cut off, which has a negative effect on the dimensional accuracy and other quality aspects. In addition, it is often desirable to prestretch the sheet-metal blank in one direction to the yield point of the material, preferably 3–6% beyond the yield point, before the forming operation in order to avoid elastic springback of the sheet-metal blank after forming. This implies a lateral contraction of the sheet-metal blank in the other direction, and in the case where there are large recesses, for example for the purpose of forming flanged edges, parallel to the stretching direction, the sheet-metal blank will be deformed by said recesses, which results in a product of inferior quality.

BRIEF SUMMARY OF THE INVENTION

The present invention aims at providing an improved forming tool for diaphragm presses, which allows the sheet blank to be cut to the desired size and a flanged edge to be formed by bending along at least part of the periphery of the sheet-shaped blank and/or along a circumferential edge of an opening therein in a single forming step, while ensuring a high degree of dimensional accuracy and shape permanence as well as a finished product of high quality. An additional advantage obtained by means of the forming tool according to the invention is that it is easier to remove both the formed product and the remaining surplus or scrap after the forming operation. At least said objects and advantages are obtained by means of a forming tool according to claim 1.

The invention is thus based on the understanding that the above objects and advantages are obtained if the forming tool, in the places where the sheet blank is to be cut and bent to form a flanged edge, is provided with an elongate cutting and flanging tool, which is displaceable with the aid of actuating means towards and away from the diaphragm in a slot in the forming tool. In one typical embodiment, the forming tool can comprise, as shown and described also in connection with the following working examples, such a cutting and flanging tool for the purpose of cutting the sheet-metal blank and bending it to form a flanged edge along the whole periphery of the blank. One example of such an application is car body panels in the form of, for example, a car hood or a car roof. However, a cutting and flanging tool could also be adapted to cut the blank and bend it to form a flanged edge along the circumference of an opening therein, for example for the purpose of forming window and ventilation openings in car body panels. It would also be conceivable to form a flanged edge by cutting and bending along only part of a body panel edge or a circumferential edge of an opening in the blank. In such cases, the cutting and flanging tool does not need to extend continuously in a closed loop, but may be arranged along a limited section having a beginning and an end.

Preferably, the cutting and flanging tool is, in an initial position, flush with the forming surface. The cutting function is achieved by the cutting and flanging tool being provided with a sharp shoulder edge, which serves as a cutting edge and which, conveniently, can have a height 1–3 times the thickness of the sheet blank to be formed. When a sufficiently high pressing pressure has been reached, the blank is cut along said edge, the cutting thus being effected before the blank has been deformed to a significant degree. Owing to the small depth of the recess, its negative influence on the blank, perpendicularly to the lateral contraction, in connection with any prestretching will be insignificant. Moreover, by arranging the cutting edge on the cutting and flanging tool, it is easy to provide a flanged edge of varying width by forming the cutting edge at different distances from the edge of the cutting and flanging tool that is oriented towards the forming surface of the forming tool against which the blank is formed.

The cutting and flanging tool is moved towards and away form the diaphragm with the aid of an arbitrary type of actuating means. In the preferred embodiment, the actuating means is formed of a plurality of hydraulically operated pistons arranged at intervals of about 100 mm. However, other types of actuating means are also conceivable. At low pressures, pneumatic pistons could be used, for instance.

In the preferred embodiment, the inward displacement of the cutting and flanging tool is controlled by the pressing pressure being exerted, by way of the diaphragm, on a release valve, which, when the pressure is high enough, is pressed inwards and actuates a valve body, which drains the hydraulic system of the pistons, thus allowing the cutting and flanging tool to be forced inwards by the pressing pressure exerted thereon. In this way, the diaphragm will press the edge portion of the cut blank into the slot in the cutting and flanging tool, so that said edge portion will form an inwardly bent flanged edge. After a possible further pressure increase aiming at a final forming of the blank, the pressure in the pressure chamber is released and the press can then be opened. By the position of the cutting and flanging tool in the slot being controllable with the aid of one or more actuating means, both the finished product and the cut-off scrap can be easily disengaged from the forming tool by the actuating means being caused to displace the cutting and flanging tool outwards. The cutting and flanging tool will thus disengage the finished product and the scrap and press them out of the forming tool. In many cases, the product and the scrap will stick firmly to the forming tool.

In the following working example, one embodiment of the forming tool for forming car body panels will be described. It will be appreciated, however, that the forming tool according to the invention can also be used for forming other sheet blanks.

BRIEF DESCRIPTION OF THE ACCOMPANYING DRAWINGS

The drawings show, by way of example, one embodiment of the invention.

DETAILED DESCRIPTION OF A PREFERRED EMBODIMENT OF THE INVENTION

In the following, an embodiment will be described in which the forming tool is used for forming sheet-metal blanks for the automotive industry.

Figure 1:
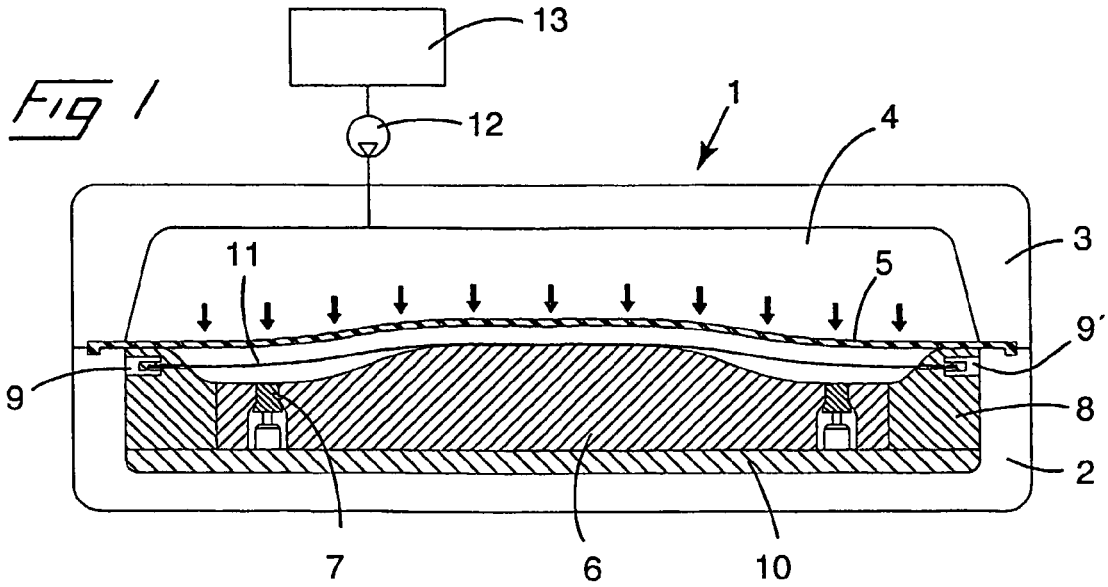
FIG. 1 is a cross section through a diaphragm press with a forming tool according to the invention arranged therein for forming car body panels.

FIG. 1 is a cross section through a diaphragm press 1. The latter includes a bottom tray 2 and an upper part 3, which, when brought together as shown in the figure, define a closed pressure chamber 4. A flexible diaphragm 5 is arranged between the bottom tray 2 and the upper part 3, which diaphragm provides a gas and liquid tight shield between the bottom tray 2 and the upper part 3.

A forming tool 6 according to the invention having an annular cutting and flanging tool 7 is arranged in the bottom tray. Edge elements 8 with schematically illustrated stretching means 9, 9' are provided between the forming tool 6 and the side walls of the bottom tray 2, and both the forming tool and the edge elements 8 rest on a bottom plate 10.

In connection with forming using the diaphragm press shown, a sheet-metal blank 11 to be formed is arranged between the forming tool 6 and the diaphragm 5, two opposite side edges thereof being inserted in the stretching means 9, 9', as shown in FIG. 1. The stretching means 9, 9' allow the sheet-metal blank to be prestretched in one direction to the yield point of the material, or preferably slightly beyond the yield point. An excess pressure is then applied in the press chamber 4 on the upper side of the diaphragm 5 by a liquid, preferably oil, being supplied at high pressure by means of a schematically illustrated pump 12 from a storage tank 13. Since the pressure on the upper side of the diaphragm 5 is increased, the latter will be pressed against the sheet-metal blank 11 and the forming tool 6, the shape of whose upper side corresponds to the desired shape of the formed end product.

Figure 2:
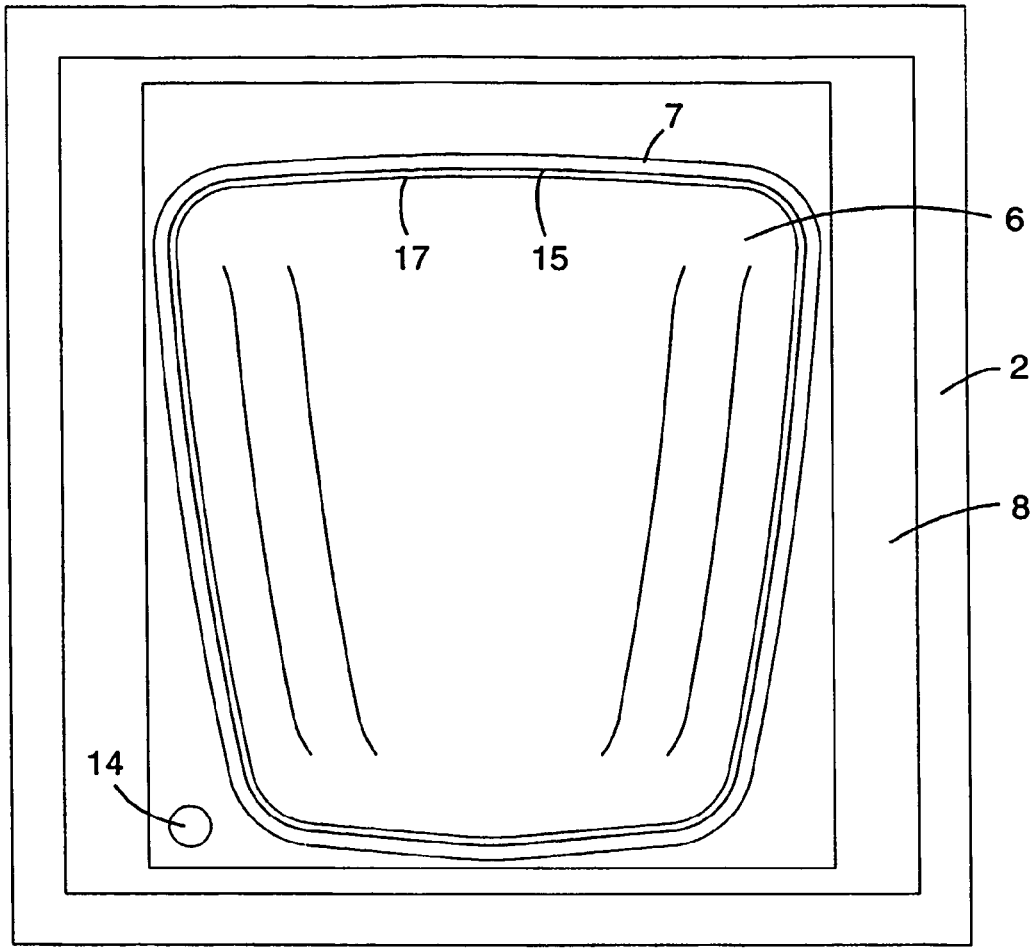
FIG. 2 is a top view of the bottom tray of the diaphragm press in FIG. 1.

FIG. 2 is a schematic top view of the bottom tray 2 with a forming tool 6 arranged therein. The forming tool shown in the figure is intended for forming sheet-metal blanks into car hoods and the annular cutting and flanging tool 7 extends along the peripheral edges of the car hood to be formed. A release valve 14, which is schematically illustrated in the lower left corner of the figure, will be described in more detail below.

Reference is now made to FIGS. 3–6, which illustrate the function of the forming tool according to the invention and, in particular, the function of the forming tool's cutting and flanging tool 7. The latter is arranged in a slot in the forming tool and its outer surface has a shoulder-shaped cross section achieved by a recess 15 being made along an edge of the cutting and flanging tool 7, said recess being located closest to the forming surface 16 against which the sheet-metal blank 11 is to be formed. A cutting edge 17 is formed between the outer-most outer surface of the cutting and flanging tool 7 and said recess 15. In the example shown, the recess 15 has a rectangular cross section. However, it could also have, for example, a wedge-shaped cross section, so that the end of the recess located closest to the forming surface 16 is flush with the forming surface. Thus, the negative influence of the recess on the sheet-metal blank in connection with the lateral contraction mentioned above during prestretching of the sheet-metal blank would be even further reduced. The cutting and flanging tool 7 is operable by means of a plurality of hydraulic cylinders 18 provided at intervals of about 100 mm along the whole circumference of the cutting and flanging tool 7.

The figures also show the release valve 14, the outer surface of which is located slightly within the outer surface of the forming tool. The release valve 14 is spring-loaded towards the exterior by means of cup springs 19 and the innermost end of the release valve comprises a valve body 20, which is capable of closing and opening a passage in a hydraulic pipe 21.

Figure 3:
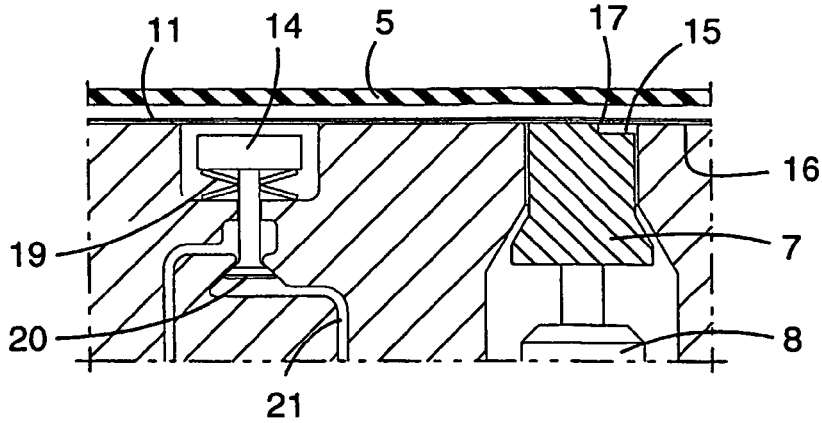
FIGS. 3–6 are schematic partial cross sections through the cutting and flanging tool and a release valve of the forming tool according to the invention at different pressing pressure levels.

In an initial position, as shown in FIG. 3, the sheet-metal blank 11 is stretched with the aid of the stretching means 9, 9', the cutting and flanging tool 7 is pressed outwards by a hydraulic pressure in the hydraulic cylinders 18 in such manner that the outermost surface of the cutting and flanging tool is flush with the forming surface 16, and the hydraulic pipe 21 is closed by the release valve 14 being pressed outwards by the spring 19. However, at this stage, no pressure has yet been applied to the outside of the diaphragm 5 and the sheet-metal blank 11 thus extends, not yet formed or cut, past both the cutting and flanging tool 7 and the release valve 14.

Figure 4:
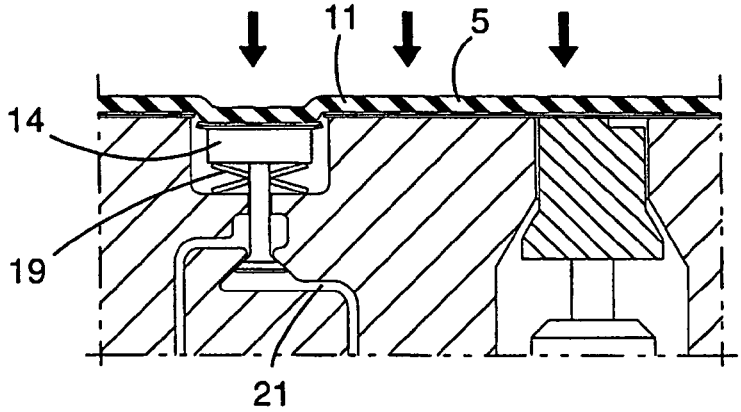

In FIG. 4, a pressure has been applied to the outside of the diaphragm 5 causing it to be pressed against the sheet-metal blank 11, and the pressure is high enough for a hole to have been stamped in the sheet-metal blank 11 along the periphery of a hole in which the release valve 14 is disposed. However, the force of the spring 19 is so great that the passage in the hydraulic pipe 21 remains closed.

Figure 5:
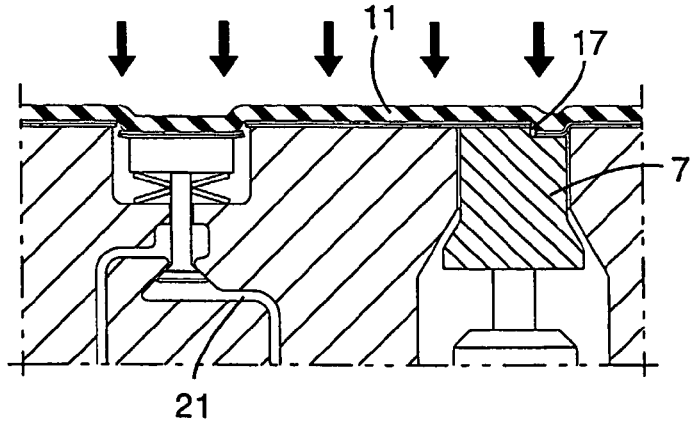

In FIG. 5, the pressure has increased further, which has caused the sheet-metal blank 11 to be cut along the cutting edge 17 of the cutting and flanging tool 7. The passage in the hydraulic pipe 21 is, however, still closed.

Figure 6:
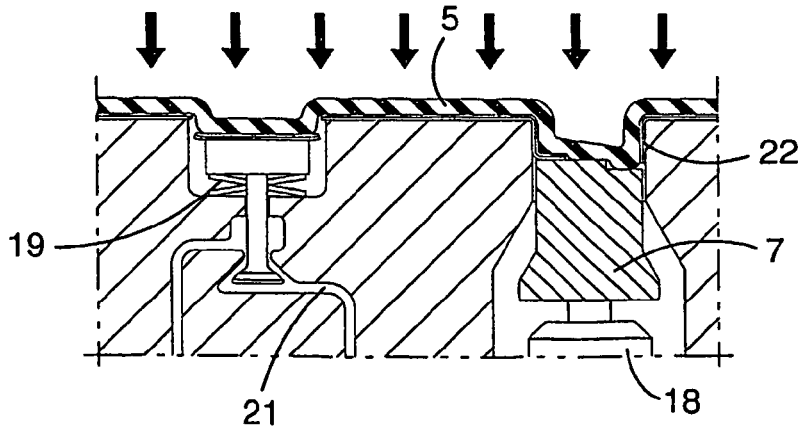

In FIG. 6, the pressure has increased even further, so that it, by way of the diaphragm 5, overcomes the spring force of the spring 19, and the release valve has been displaced inwards in such manner that the passage in the hydraulic pipe 21 has been opened. The hydraulic liquid is thus drained from the hydraulic pistons 18 and the cutting and flanging tool 7 is displaced into the forming tool. The diaphragm 5 will thus form a flanged edge 22 by bending along the periphery of the part of the cut sheet-metal blank 11 that is located above the forming surface 16 and that will form the finished product.

Figure 7:
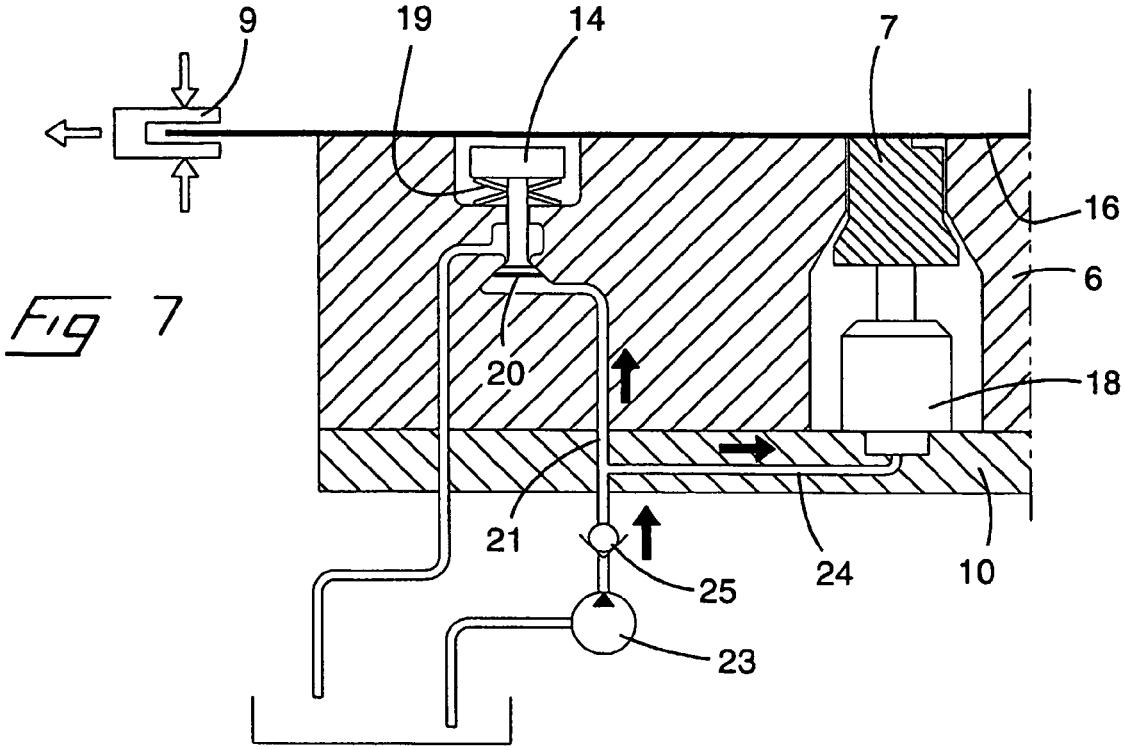
FIGS. 7 and 8 are partial cross sections similar to those in FIGS. 3–6, which illustrate the function of the release valve in greater detail.

In the schematic cross sections 7 and 8, the function of the release valve 14 is shown in more detail. In FIG. 7, which corresponds to FIG. 3, the forming tool 6 is in an initial position, the sheet-metal blank 11 being stretched over it with the aid of the stretching means 9, 9'. A pump 23 is used to generate a pressure in a hydraulic pipe 24, which extends through the bottom plate 10 to each of the hydraulic cylinders 18, such that the cutting and flanging tool 7 is displaced upwards and its outer-most surface is flush with the forming surface 16 of the forming tool. The pressure in the pipe 24 is maintained by means of a check valve 25 and as long as the passage in the pipe 21, which communicates with the pipe 24, is closed by the valve body 20 owing to the fact that the release valve 14 is pressed outwards by the spring 19, no hydraulic liquid can be evacuated there either.

Figure 8:
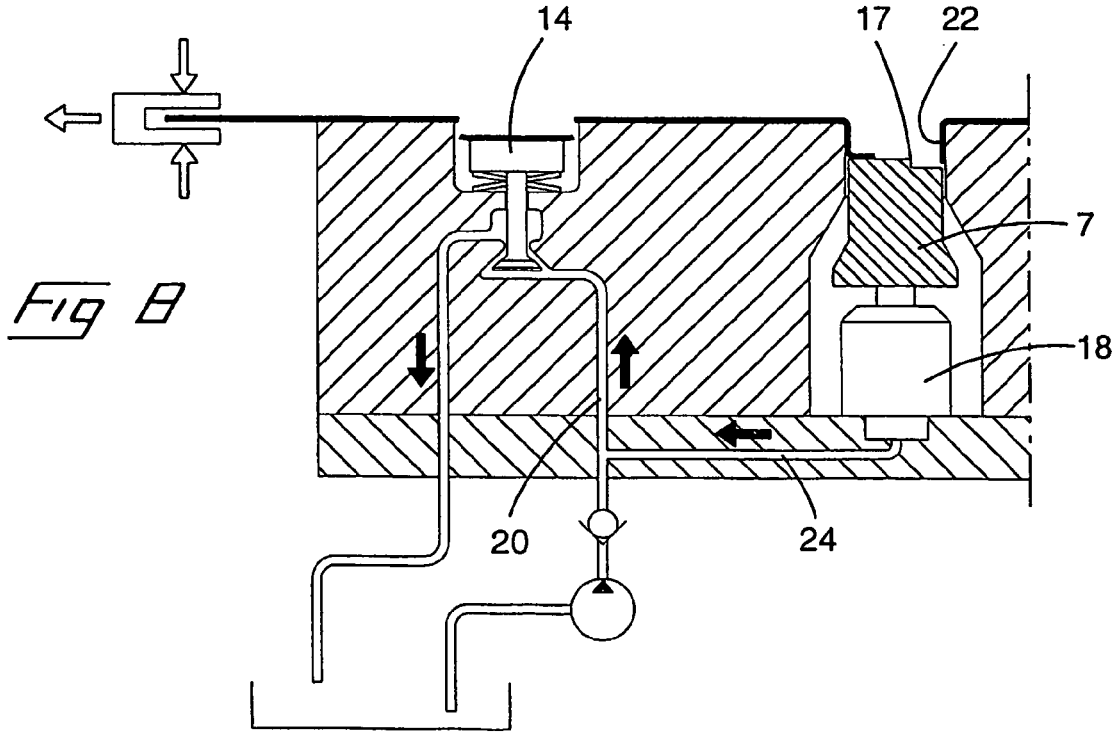

In FIG. 8, which corresponds to FIG. 6, the diaphragm (not shown in this figure) has pressed the release valve 14 down, so that the passage in the pipe 21 is open. This allows hydraulic liquid to be evacuated through the pipe 21 and the pressure in the hydraulic cylinders 18 to be released. The diaphragm then causes an inward displacement of the cutting and flanging tool 7 and the flanged edge 22 is bent along the periphery of the sheet-metal blank.

After the forming operation has been completed, when the pressure has been released from the press chamber 4 and the upper part 3 of the press as well as the diaphragm 5 have been removed, the release valve 14 will return to its initial projecting position, thus causing the passage in the hydraulic pipe 21 to close. By generating once more, at this stage, a hydraulic pressure in the pipe 24, the hydraulic cylinders 18 will cause an outward displacement of the cutting and flanging tool 7 and both the finished product and the remaining scrap will be displaced outwards and disengaged from the forming tool.

Figure 9:
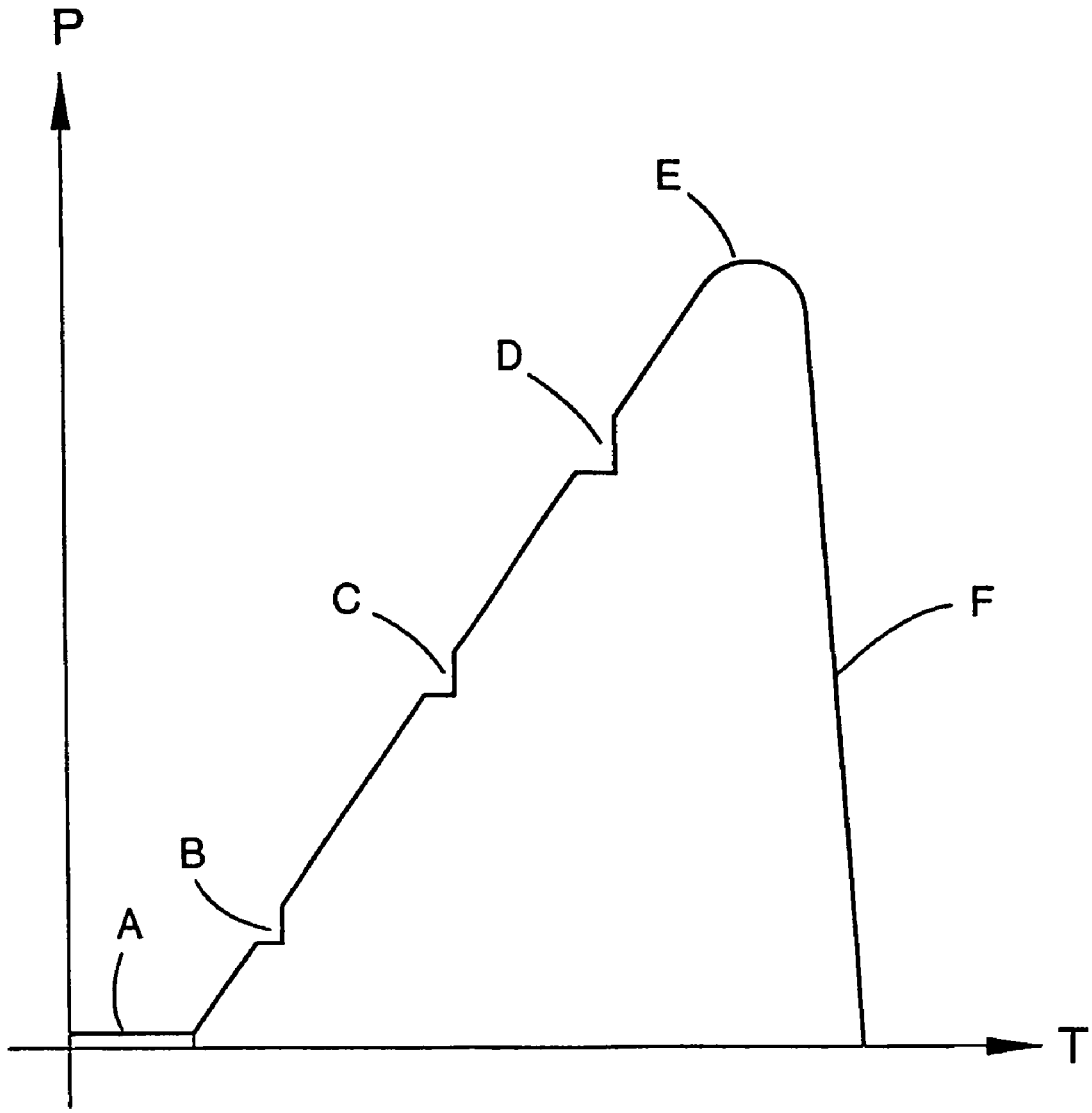
FIG. 9 is a pressure/time chart illustrating the pressure levels during different time intervals of a forming cycle.

FIG. 9 shows a pressure/time chart illustrating the pressure in the press chamber during different time intervals of the forming operation. At A the sheet-metal blank 11 is stretched with the aid of the stretching means 9, 9' to the yield point of the material. The press chamber is then pressurised in such manner that the diaphragm 5 is pressed against the sheet-metal blank 11 and the forming tool, and at B the hole is cut out above the release valve 14. During a continued pressure increase, point C is reached, at which the sheet-metal blank is cut along the cutting edge 17 of the cutting and flanging tool 7. With a further pressure increase point C is reached, at which the release valve 14 is pressed inwards by the diaphragm, so that he hydraulic pistons 18 are drained. This causes the cutting and flanging tool 7 to be displaced inwards and the flanged edge 22 to be formed by bending along the periphery of the cut sheet-metal blank. The pressure is then increased slightly more to point E in order to further reinforce and define the shape of the sheet-metal blank on the forming tool. Finally, the pressure in the press chamber is released and drops to atmospheric pressure, as illustrated by the curve section F. The cut, flanged and formed product can then be removed from the press to be further processed.

The invention claimed is:

1. A forming tool for forming sheet blanks in a diaphragm press of the kind comprising an openable, closed pressure chamber, which is divided in a gas and liquid tight manner by means of a flexible diaphragm, the forming tool being adapted to be arranged on one side of the diaphragm and a sheet blank to be formed being adapted to be arranged between the forming tool and the diaphragm, while the opposite side of the diaphragm is adapted to be pressurized by a fluid being supplied at high pressure to cause the flexible diaphragm to deform and, thus, the sheet blank to be pressed against the forming tool, the forming tool comprising:

a cutting edge, so that the sheet blank is both formed into the desired shape and cut to the desired size in a single forming step; and an elongate cutting and flanging tool along at least part of its periphery and/or around an intended opening in the sheet blank, the cutting and flanging tool having a cutting edge and being displaceable, with the aid of actuating means, in an elongate slot in the forming tool towards and away from the diaphragm, in such manner that, at a first pressing pressure, the sheet blank is caused to be cut off against the cutting edge and, as the pressure is continuously increased, the cutting and flanging tool is caused to be displaced into the slot in the forming tool away from the diaphragm, so that the peripheral edge of the sheet blank and/or the circumferential edge around an opening therein is/are deformed towards the interior of the slot during forming of a flanged edge in the sheet blank.

2. The forming tool as claimed in claim 1, wherein the actuating means comprises a plurality of hydraulic cylinders along the longitudinal extent of the cutting and flanging tool.

3. The forming tool as claimed in claim 1, wherein the cutting edge of the cutting and flanging tool is formed by a recess along a longitudinal edge of the cutting and flanging tool that is oriented towards a forming surface of the forming tool, the width of the recess corresponding to the width of the flanged edge to be formed.

4. The forming tool as claimed in claim 3, wherein the recess of the cutting and flanging tool has a varying width along its longitudinal extent so as to form a flanged edge of varying width.

5. The forming tool as claimed in claim 1, wherein, in an initial, projecting position, an outermost surface of the cutting and flanging tool is flush with a forming surface of the forming tool.

6. A diaphragm press comprising an openable, closed pressure chamber, which is divided in a gas and liquid tight manner by means of a flexible diaphragm, and a forming tool, wherein the forming tool is adapted to be arranged on one side of the diaphragm and a sheet blank to be formed being adapted to be arranged between the forming tool and the diaphragm, while the opposite side of the diaphragm is adapted to be pressurized by a fluid being supplied at high pressure to cause the flexible diaphragm to deform and, thus, the sheet blank to be pressed against the forming tool, the forming tool comprising:

a cutting edge, so that the sheet blank is both formed into the desired shape and cut to the desired size in a single forming step; and an elongate cutting and flanging tool along at least part of its periphery and/or around an intended opening in the sheet blank, the cutting and flanging tool having a cutting edge and being displaceable, with the aid of actuating means, in an elongate slot in the forming tool towards and away from the diaphragm, in such manner that, at a first pressing pressure, the sheet blank is caused to be cut off against the cutting edge and, as the pressure is continuously increased, the cutting and flanging tool is caused to be displaced into the slot in the forming tool away from the diaphragm, so that the peripheral edge of the sheet blank and/or the circumferential edge around an opening therein is/are deformed towards the interior of the slot during forming of a flanged edge in the sheet blank.

* * * * *